United States Patent [19]

James Jr.

[11] 4,393,439

[45] Jul. 12, 1983

[54] CONVERTIBLE LANTERN AND REFLECTOR THEREFOR

[76] Inventor: Harry E. James Jr., 75 Forbes Rd., Bedford, Ohio 44146

[21] Appl. No.: 171,307

[22] Filed: Jul. 23, 1980

[51] Int. Cl.[3] ..... F21V 17/00

[52] U.S. Cl. ..... 362/182; 362/180; 362/266; 362/294; 362/350; 362/375; 362/399

[58] Field of Search ..... 362/182, 180, 266, 294, 362/350, 375, 399

[56] References Cited

U.S. PATENT DOCUMENTS 1,202,514 10/1916 Hasen ..... 362/164 X 1,230,892 6/1917 Hansen ..... 362/160

4,172,275 10/1979 Caverio ..... 362/159

*Primary Examiner*—Stephen J. Lechert, Jr.

[57] ABSTRACT

A hydrocarbon-burning lantern is convertible from a broadcast configuration to a spotlight configuration. The cover, glass housing, and bail of a conventional lantern are removed and replaced with a semi-spherical reflector having a glass-covered opening and a handle. A ring clamps the glass window against the open face of the reflector. A number of vent openings are provided in the reflector to cool the lantern and permit the lantern to be lighted. The handle permits the lantern to be maneuvered effectively.

11 Claims, 5 Drawing Figures

CONVERTIBLE LANTERN AND REFLECTOR THEREFOR

CROSS-REFERENCE TO RELATED APPLICATION

Reflector, design patent application Ser. No. 171,313, filed July 23, 1980, by Harry E. James, Jr.

BACKGROUND OF THE INVENTION

1. Field of the Invention

The invention relates to lanterns and, more particulary, to a reflector for converting a broadcast-type hydrocarbon-burning lantern to a spotlight.

2. Description of the Prior Art

Lanterns burning hydrocarbon fuels such as propane, kerosene, and the like have been known for a number of years. These lanterns are relatively inexpensive to manufacture and the ready availability of fuel enhances the convenience of the lanterns. The lanterns are sufficiently compact and lightweight that they have become quite popular for camping and other recreational activities.

Although these lanterns function effectively, certain considerations have not been adequately addressed. One of these considerations relates to the quality of light emitted by the lanterns. Generally speaking, the lanterns are provided with a translucent glass housing through which light is broadcast in all directins. If a lantern is suspended in an elevated position, a great deal of light will be emitted and a fairly substantial area can be illuminated. A problem, however, occurs if the lantern is placed on a table, rather than being suspended overhead. The quantity of emitted light is such that the lantern may be too bright for people located close to the lantern. Moreover, the lantern functions quite effectively to attract insects; obviously, this can be undesirable in many circumstances.

An additional consideration relates to the effectiveness of the lantern when it is desired to move about. Basically, the lantern has to be held overhead so that enough light can be scattered about to illuminate one's path. Travel can be difficult, particularly if it is very dark or if one wishes to cover unfamiliar ground.

In an apparent attempt to alleviate these difficulties, it has been proposed to provide a reflector for lanterns. One prior lantern employs a reflector clipped to a glass housing by means of flexible straps. The reflector is trough-like and semi-circular when viewed from the end. Other devices employing a trough-like, semi-circular reflector placed in proximity with the glass housing of a lantern are known. One of these devices includes a frame connected to the lantern at the base and at the top. A handle also is provided for the frame. Certain of the prior reflectors are spaced from the glass housing to maintain the reflectors at a relatively low temperature.

It also is known to place a so-called bug shield in proximity with the lantern so that light emitted by the lantern will be unattractive to insects and so that the brightness of the lantern can be reduced for the benefit of nearby people. Another lantern employs an adjustable light-reflective shield to produce different light-reflective characteristics. Still another lantern employs a reflector disposed above an illuminating element to reflect light generally downwardly.

The prior devices have not adequately addressed the problem of providing effective, concentrated illumination emitted by a lantern. Although the reflectors included as part of prior lanterns indeed reflect light and concentrate it to some extent, they fail to completely deal with the problem. The prior lanterns also are difficult to hold during normal operation of the lantern because of a failure to provide an effective handle.

SUMMARY OF THE INVENTION

The present invention provides a new and improved lantern by which a conventional broadcast lantern having a glass housing, cover, and bail can be converted to a spotlight. Essentially, the glass housing, cover, and bail of a conventional lantern are removed and replaced by a semispherical reflector. The reflector includes an opening covered by a glass window, the glass window being held in place by a ring. The reflector includes a plurality of vent openings near the window. Other vent openings are provided in the reflector to provide proper airflow and to permit the lantern to be lighted.

A vertically oriented handle is mounted to an upper mounting member included as part of the lantern and to a lower mounting member located near the lower portion of the reflector. Taken together, the reflector and handle are lightweight, compact, and permit the lantern to be carried conveniently. Importantly, the reflector concentrates light far more effectively than reflectors employed with prior lanterns.

The foregoing and other features and advantages, and a fuller understanding of the invention, may be had by referring to the following description and claims, taken in conjunction with the accompanying drawings.

DESCRIPTION OF THE PREFERRED EMBODIMENT

Figure 1:
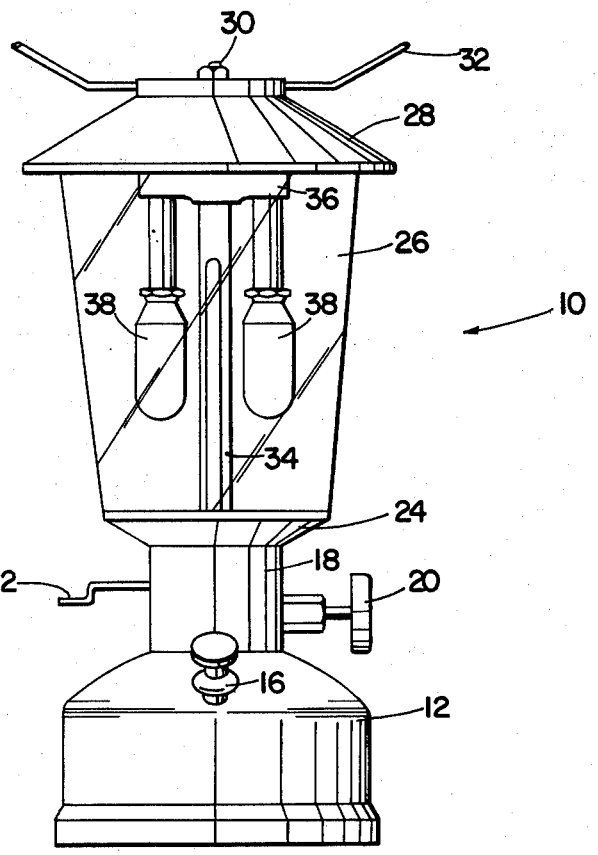
Fig. 1 PRIOR ART
FIG. 1 is a perspective view of a typical prior art hydrocarbon-burning lantern.

Referring to FIG. 1, a conventional hydrocarbon-burning lantern 10 is shown. The lantern 10 includes a tank 12 within which fuel can be carried and which will support the lantern 10 securely on a flat surface. Although the lantern 10 typically burns a fuel such as gasoline, other hydrocarbon fuels can be used, if desired. For example, propane as is commonly supplied in a small metal bottle can be used, in which event the tank 12 would be replaced by a propane bottle having a specially configured base portion. The type of fuel burned by the lantern 10 and the configuration of the tank 12 are conventional and do not form a part of the present invention.

Figure 2:
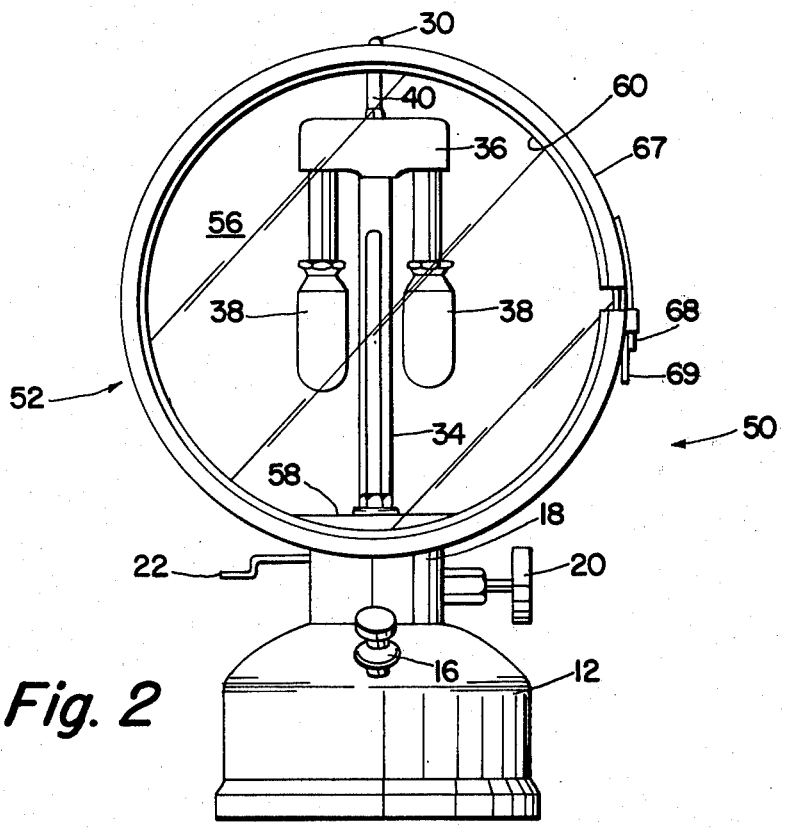
FIG. 2 is a front elevational view of a lantern having a reflector according to the invention.
Figure 3:
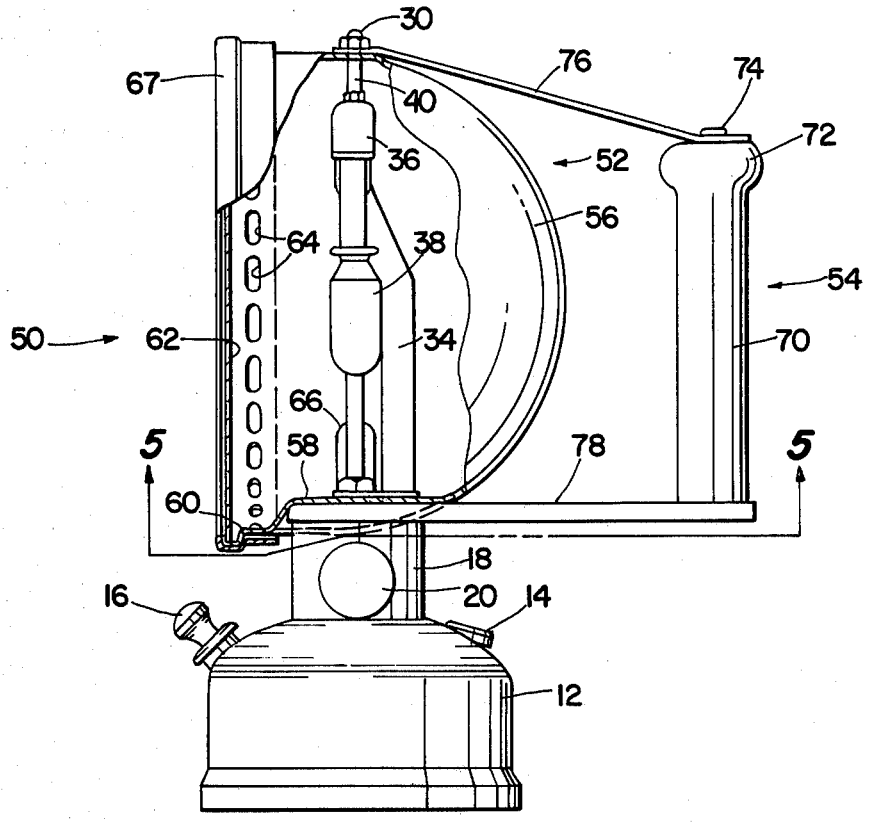
FIG. 3 is a side elevational view of the lantern of FIG. 2, with portions of the reflector being broken away and removed for clarity.
Figure 4:
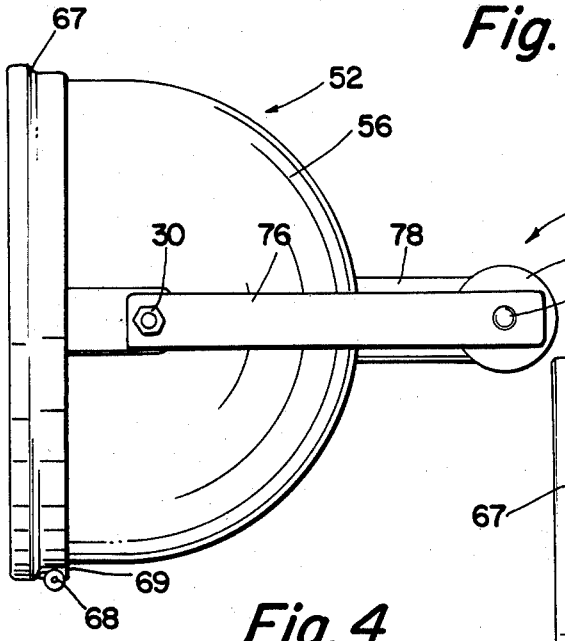
FIG. 4 is a top plan view of the lantern of FIG. 3.
Figure 5:
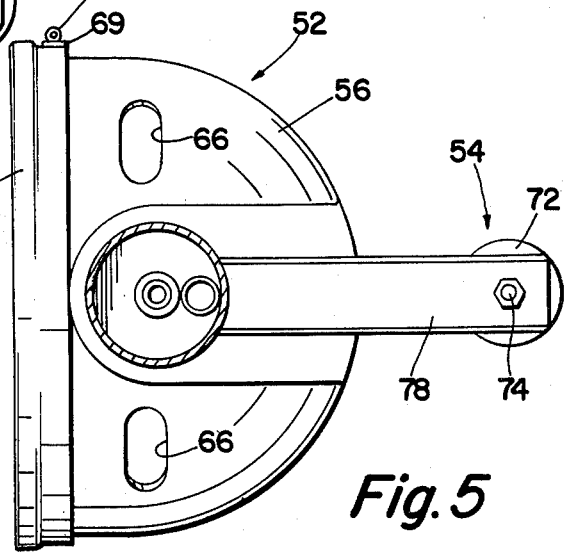
FIG. 5 is a view taken along a plane indicated by line 5—5 in FIG. 3.

Referring to FIGS. 2 and 3, the tank 12 includes a filler opening enclosed by a cover 14. A pump 16 projects outwardly of the tank 12 and is utilized to pressurize contents of the tank 12. A cylindrical spacer 18 extends upwardly from the central region of the tank 12 and provides support for other elements of the lantern 10. A valve control 20 extends outwardly of the spacer 18 to permit pressurized fuel to be selectively discharged from the tank 12. A lever 22 extends outwardly of the spacer 18 on the side opposite the valve control 20. The lever 22 is used to clean a mixing valve (not shown) included as part of the lantern 10.

A baseplate 24 is disposed atop the spacer 18 and a generally cylindrical glass housing 26 is disposed atop the plate 24. A flattened cover 28 is positioned atop the housing 26 and is held in place there by a nut 30. A bail 32 is secured to the cover 28 and permits the lantern 10 to be carried or suspended. A vertically extending tube 34 is positioned centrally within the housing 26. The tube 34 conveys a combustible fuel-air mixture from the tank 12 and the mixing valve to a manifold 36. A pair of mantles 38 depend from the manifold 36. A stud 40 extends upwardly from the manifold 36 and provides support for the cover 28 as well as an attachment point for the nut 30.

A lantern 50 according to the invention is shown in FIGS. 2 and 3. Many of the elements of the lantern 50 are the same as those described already with respect to the lantern 10. Where appropriate, reference numerals employed earlier will be used to describe elements of the lantern 50.

The lantern 50 includes a semi-spherical reflector 52 secured in place atop the spacer 18. A vertically oriented handle 54 is positioned at the backside of the reflector 52. The reflector 52 includes a metal shell 56 having a light-reflective inner surface and a flattened bottom portion 58 adapted to rest securely atop the upper portion of the spacer 18. The shell 56 typically will be manufactured from 18 gauge aluminum in a stamping operation. The bottom portion 58 includes an opening to enable the shell 56 to be fitted over the tube 34, the manifold 30, and the mantles 38. The shell 56 includes an enlarged rim 60 within which a window in the form of a pane of heat-tempered glass 62 is placed. In order to properly vent the reflector 52, a plurality of openings 64 are located in the shell 56 near the rim 60. A pair of larger openings 66 are formed near the lower portion 58 to permit air to flow into the volume defined by the reflector 52 and to permit the mantles 38 to be lighted. In order to hold the glass 62 firmly against the front portion of the shell 56, a band 67 encircles the rim 60. The band 67 is spaced from the shell 56 so that air may flow through the openings 64. The band 67 is clamped tightly against the rim 60 by an interlocking threaded plug 68 and slotted tab 69.

The handle 54 includes a vertically extending wooden section 70 having an enlarged upper end 72 to facilitate ease of carrying the lantern 50. A pin 74 extends the length of the wooden section 70 and is connected to the stud 36 by means of a first brace 76. A second brace 78 connects the lower end of the pin 74 with the lantern 50 at the interface between the shell 56 and the spacer 18. The second brace 78 includes appropriate openings to enable it to be fitted about the tube 30.

It will be appreciated that the lantern 50 according to the invention is exceedingly inexpensive and easy to manufacture. Disassembly of the lantern 10 and assembly of the lantern 50 can be carried out expeditiously. The invention, as illustrated, provides a general purpose spotlight. Other configurations of reflectors may be used such that light distribution patterns suitable for specific needs can be provided. Such alternate reflector configurations will be apparent to those skilled in the art and further description is not necessary here. In order to accommodate differently shaped reflectors, the only structural change which might be necessary is the provision of a different stud 40.

With the foregoing considerations in mind, it will be understood that the present disclosure of the preferred embodiment has been made only by way of example and, although the invention has been described in its preferred form with a certain degree of particularity numerous changes may be resorted to without departure from the true spirit and scope of the invention as hereinafter claimed. It is intended that the patent shall cover by suitable expression in the appended claims, whatever features of patenable novelty exist in the invention disclosed.

What is claimed is:

1. A reflector for use with a portable lantern having a base portion, a light-emitting element positioned above the base portion, and a translucent housing surrounding the light-emitting element, the reflector adapted to replace the housing and enable the lantern to operate as a spotlight, comprising:

(a) a shell disposed about the light-emitting element, the shell having a light-reflective inner surface;

(b) openings in the shell to permit the ingress and egress of cooling air;

(c) a window secured to the open side of the shell; and (d) a handle attached to the lantern by which the lantern can be readily maneuvered, the handle being positioned on that side of the shell opposite the window.

2. The reflector of claim 1, wherein the shell is semi-spherical.

3. The reflector of claim 1, wherein:

(a) the lantern includes at least one vertically extending member to support the light-emitting element;

(b) the shell includes an opening at its bottom portion to enable the shell to be fitted about the vertically extending member; and (c) the light-emitting element includes a support near its upper end, the support being attached to the shell to secure the shell in place atop the lantern base.

4. The reflector of claim 3, wherein the handle is attached to the lantern at the connection between the shell and the base portion, and also is attached to the lantern at or near the connection between the support and the shell.

5. The reflector of claim 1, wherein the shell is comprised of aluminum of a thickness suitable for shaping in a stamping operation.

6. A hydrocarbon burning lantern suitable for use in one mode as a broadcast lantern and in another mode as a spotlight, the spotlight configuration of the lantern comprising:

(a) a base portion for supporting the lantern;

(b) a vertically extending spacer projecting from the upper part of the base portion;

(c) at least one light-emitting element positioned above the spacer and held in position there by a member extending vertically upwardly from the spacer;

(d) a support connected to the vertically extending member and disposed above the upper end of the light-emitting element;

(e) a shell having a light-reflective inner surface disposed about the light-emitting element, the shell including a bottom portion adapted to tightly mate with the top of the spacer, the shell including an opening near its upper portion by which the shell can be secured to the support;

(f) a window fitted to the open side of the shell; and (g) a handle positioned on the opposite side of the shell from the window and secured to the lantern at the interface between the spacer and the shell, the handle also being secured to the lantern at the interface between the support and the opening in the upper portion of the shell.

7. The lantern of claim 6, wherein the shell is semi-spherical.

8. The lantern of claim 6, wherein the shell includes openings near its lower portion for admitting cooling air and for permitting the lantern to be lighted, the shell also including openings located near the window to permit heated air to be exhausted from the shell.

9. The lantern of claim 6, wherein the handle comprises:

(a) a vertically oriented member having an enlarged upper portion;

(b) a first brace connecting the enlarged upper portion of the handle to the support; and (c) a second brace connecting the lower portion of the vertically oriented member to the lantern at the interface between the shell and the spacer.

10. The lantern of claim 6, wherein the window is held in place by a band extending circumferentially about the periphery of the shell.

11. A reflector for use with a portable lantern having a base portion, a light-emitting element positioned above the base portion, a translucent housing surrounding the light-emitting element, a vertically extending member projecting upwardly from the base portion, the vertically extending member supporting the light-emitting element, and a support connected to the vertically extending member and disposed above the upper end of the light-emitting element, the reflector adapted to replace the housing and enable the lantern to operate as a spotlight, comprising:

a semi-spherical shell having a light-reflective inner surface disposed about the light-emitting element, the shell including a bottom portion adapted to mate with the top of the base portion, the shell including an opening near its upper portion by which the shell can be secured to the support, the shell also including openings near its lower portion for admitting cooling air and for permitting the lantern to be lighted, the shell additionally including openings located near the open side of the shell to permit heated air to be exhausted from the shell;

a window fitted to the open side of the shell, the window being held in place by a band extending circumferentially about the periphery of the shell; and a handle positioned on the opposite side of the shell from the window and secured to the lantern at the interface between the spacer and shell, the handle also being secured to the lantern at the interface between the support and the upper portion of the shell, the handle including:

a vertically oriented member having an enlarged upper portion;

a first brace connecting the enlarged upper portion of the vertically oriented member to the support; and, a second brace connecting the lower portion of the vertically oriented member to the lantern at the interface between the shell and the base portion.

* * * * *